US006132604A

United States Patent [19]

Kirchoff

[11] Patent Number: 6,132,604

[45] Date of Patent: Oct. 17, 2000

[54] POOL SKIMMER

[76] Inventor: Robert Kirchoff, 832 S. 57th, West Allis, Wis. 53214

[21] Appl. No.: 09/282,924

[22] Filed: Apr. 1, 1999

[51] Int. Cl.[7] ..... E04H 4/16

[52] U.S. Cl. ..... 210/169; 210/470; 43/11

[58] Field of Search ..... 210/169, 470, 210/471, 238; 15/1.7; 43/11, 12

[56] References Cited

U.S. PATENT DOCUMENTS

| | | | |
|---|---|---|---|
| 4,152,801 | 5/1979 | Lieber | 210/470 |
| 4,225,437 | 9/1980 | Woodard | 210/470 |
| 4,822,487 | 4/1989 | Soich | 210/470 |
| 4,846,972 | 7/1989 | Anderson | 210/470 |
| 4,888,842 | 12/1989 | McKamey et al. | 210/470 |
| 5,139,660 | 8/1992 | Lourie et al. | 210/470 |
| 5,173,181 | 12/1992 | McFarland | 210/470 |
| 5,223,135 | 6/1993 | MacPhee et al. | 210/470 |
| 5,473,786 | 12/1995 | Resh | 210/470 |
| 5,536,107 | 7/1996 | Baker | 210/470 |
| 5,858,221 | 1/1999 | Conrad | 210/470 |

*Primary Examiner*—Robert J. Popovics

[57] ABSTRACT

A pool skimmer for quickly skimming a pool to remove debris. The pool skimmer includes an elongate pole handle and at least one skimming net assembly. The pole handle has opposite proximal and distal ends. Each skimming net assembly comprises an open frame and a net screen. The open frame defines a central opening which the net screen extends across. One end portion of the open frame is pivotally coupled to the distal end of the pole handle. The other end portion of the open frame of the skimming net assembly is adapted for detachable attachment to an end portion of an open frame of another skimming net assembly.

7 Claims, 2 Drawing Sheets

POOL SKIMMER

BACKGROUND OF THE INVENTION

1. Field of the Invention

The present invention relates to pool skimmers and more particularly pertains to a new pool skimmer for quickly skimming a pool to remove debris.

2. Description of the Prior Art

The use of pool skimmers is known in the prior art. More specifically, pool skimmers heretofore devised and utilized are known to consist basically of familiar, expected and obvious structural configurations, notwithstanding the myriad of designs encompassed by the crowded prior art which have been developed for the fulfillment of countless objectives and requirements.

Known prior art pool skimmers include U.S. Pat. Nos. 4,846,972; 5,385,666; 4,198,720; 4,003,100; 3,188,668; and U.S. Pat. No. Des. 365,381.

While these devices fulfill their respective, particular objectives and requirements, the aforementioned patents do not disclose a new pool skimmer. The inventive device includes an elongate pole handle and at least one skimming net assembly. The pole handle has opposite proximal and distal ends. Each skimming net assembly comprises an open frame and a net screen. The open frame defines a central opening which the net screen extends across. One end portion of the open frame is pivotally coupled to the distal end of the pole handle. The other end portion of the open frame of the skimming net assembly is adapted for detachable attachment to an end portion of an open frame of another skimming net assembly.

In these respects, the pool skimmer according to the present invention substantially departs from the conventional concepts and designs of the prior art, and in so doing provides an apparatus primarily developed for the purpose of quickly skimming a pool to remove debris.

SUMMARY OF THE INVENTION

In view of the foregoing disadvantages inherent in the known types of pool skimmers now present in the prior art, the present invention provides a new pool skimmer construction wherein the same can be utilized for quickly skimming a pool to remove debris.

The general purpose of the present invention, which will be described subsequently in greater detail, is to provide a new pool skimmer apparatus and method which has many of the advantages of the pool skimmers mentioned heretofore and many novel features that result in a new pool skimmer which is not anticipated, rendered obvious, suggested, or even implied by any of the prior art pool skimmers, either alone or in any combination thereof.

To attain this, the present invention generally comprises an elongate pole handle and at least one skimming net assembly. The pole handle has opposite proximal and distal ends. Each skimming net assembly comprises an open frame and a net screen. The open frame defines a central opening which the net screen extends across. One end portion of the open frame is pivotally coupled to the distal end of the pole handle. The other end portion of the open frame of the skimming net assembly is adapted for detachable attachment to an end portion of an open frame of another skimming net assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool skimmer apparatus and method which has many of the advantages of the pool skimmers mentioned heretofore and many novel features that result in a new pool skimmer which is not anticipated, rendered obvious, suggested, or even implied by any of the prior art pool skimmers, either alone or in any combination thereof.

It is another object of the present invention to provide a new pool skimmer which may be easily and efficiently manufactured and marketed.

It is a further object of the present invention to provide a new pool skimmer which is of a durable and reliable construction.

An even further object of the present invention is to provide a new pool skimmer which is susceptible of a low cost of manufacture with regard to both materials and labor, and which accordingly is then susceptible of low prices of sale to the consuming public, thereby making such pool skimmer economically available to the buying public.

Still yet another object of the present invention is to provide a new pool skimmer which provides in the apparatuses and methods of the prior art some of the advantages thereof, while simultaneously overcoming some of the disadvantages normally associated therewith.

Still another object of the present invention is to provide a new pool skimmer for quickly skimming a pool to remove debris.

Yet another object of the present invention is to provide a new pool skimmer which includes an elongate pole handle and at least one skimming net assembly. The pole handle has opposite proximal and distal ends. Each skimming net assembly comprises an open frame and a net screen. The open frame defines a central opening which the net screen extends across. One end portion of the open frame is pivotally coupled to the distal end of the pole handle. The other end portion of the open frame of the skimming net assembly is adapted for detachable attachment to an end portion of an open frame of another skimming net assembly.

Still yet another object of the present invention is to provide a new pool skimmer that can be easily lengthened to cover larger portions of a pool.

Even still another object of the present invention is to provide a new pool skimmer that can be used by two users to skim large pools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
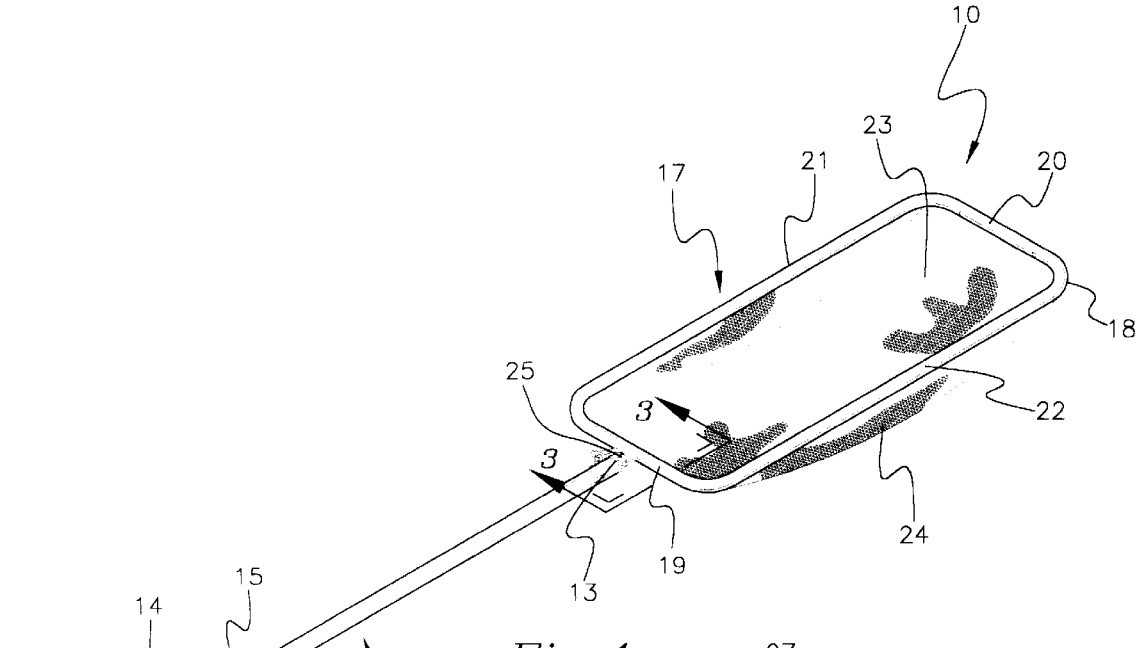
FIG. 1 is a schematic perspective view of a new pool skimmer according to the present invention.
Figure 2:
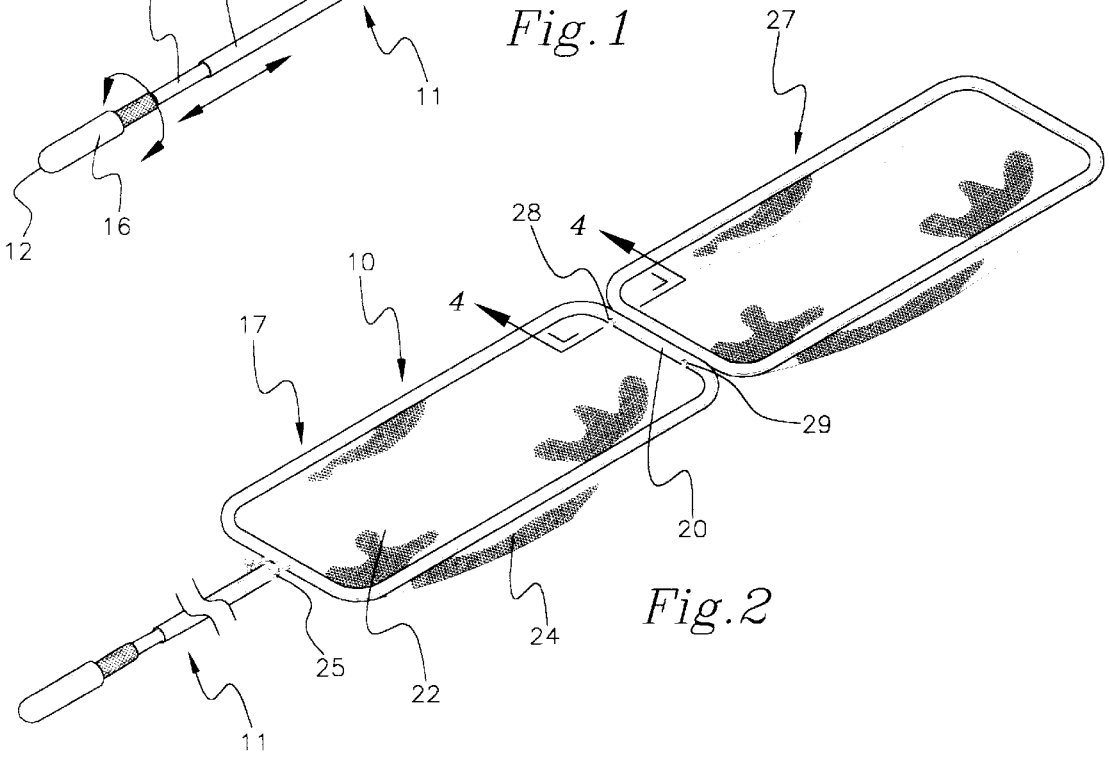
FIG. 2 is a schematic perspective view of the present invention.
Figure 3:
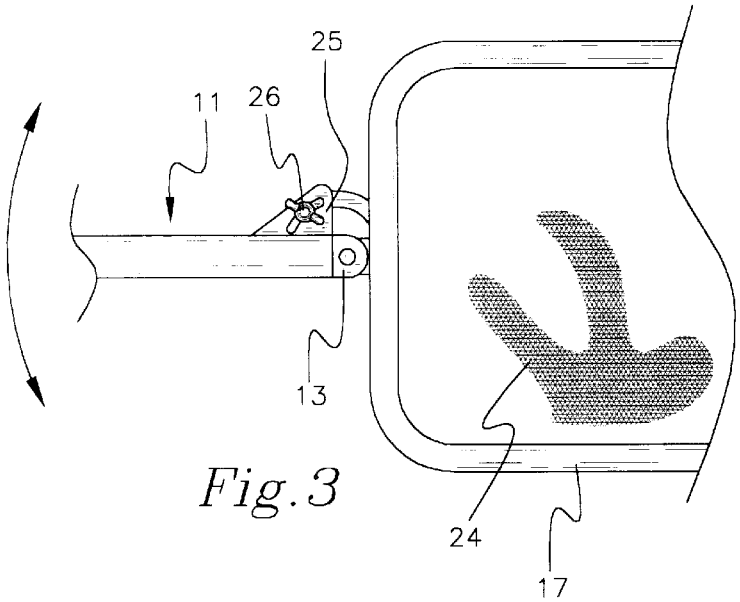
FIG. 3 is a schematic partially cross sectional view illustrating the pivot coupling of the present invention as seen from line 3—3 of FIG. 1
Figure 4:
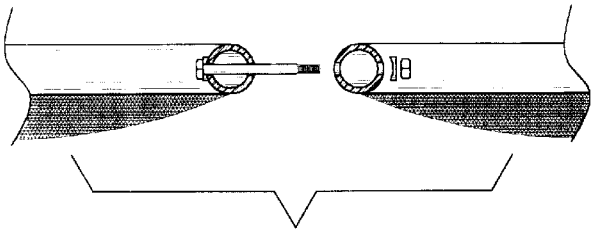
FIG. 4 is a schematic exploded cross sectional view of a coupling of two skimming net assemblies of the present invention taken from line 4—4 of FIG. 2.

With reference now to the drawings, and in particular to FIGS. 1 through 5 thereof, a new pool skimmer embodying the principles and concepts of the present invention and generally designated by the reference numeral 10 will be described.

As best illustrated in FIGS. 1 through 5, the pool skimmer 10 generally comprises an elongate pole handle 11 and at least one skimming net assembly 17. The pole handle 11 has opposite proximal and distal ends 12,13. Each skimming net assembly 17 comprises an open frame 18 and a net screen 24. The open frame 18 defines a central opening 23 which the net screen 24 extends across. One end portion 19 of the open frame 18 is pivotally coupled to the distal end 13 of the pole handle 11. The other end portion 20 of the open frame 18 of the skimming net assembly 17 is adapted for detachable attachment to an end portion of an open frame 18 of another skimming net assembly 17.

In closer detail, the elongate pole handle 11 has opposite proximal and distal ends 12,13, and a longitudinal axis extending between the proximal and distal ends 12,13 of the pole handle 11. The pole handle 11 preferably has a generally circular cross section taken generally perpendicular to the longitudinal axis of the pole handle 11. The pole handle 11 has a length defined between the proximal and distal ends 12,13 of the pole handle 11. Preferably, the length of the pole handle 11 is greater than about 3 feet. Ideally, the length of the pole handle 11 is about 7 feet. The pole handle 11 is also preferably telescopically extendable to permit selective lengthening of the length of the pole handle 11 by a user. In the preferred embodiment, the pole handle 11 has a pair of telescopic portions 14,15 and a twisting knob 16 at the proximal end 12 of the pole handle 11. The twisting knob 16 is adapted for releasably holding the telescopic portions 14,15 of the pole handle 11 in a position to fix the pole handle 11 at a particular length when the twisting knob 16 is tightened.

The pool skimmer 10 also includes at least one skimming net assembly 17. Each skimming net assembly 17 comprises an open frame 18 and a net screen 24. The open frame 18 is preferably generally rectangular and has a spaced apart pair of elongate end portions 19,20, and a spaced apart pair of elongate side portions 21,22 extending between the end portions 19,20 of the open frame 18. The portions of the open frame 18 define a central opening 23. Ideally, the open frame 18 has rounded corners. The end portions 19,20 of the open frame 18 are preferably generally parallel to one another. The side portions 21,22 of the open frame 18 are preferably generally parallel to one another and generally perpendicular to the end portions 19,20 of the open frame 18. Additionally, the end and side portions 21,22 of the open frame 18 preferably lie in a generally common plane. The open frame 18 has a length defined between the end portions 19,20 of the open frame 18 and a width defined between the side portions 21,22 of the open frame 18. Preferably, the length of the open frame 18 is greater than about 24 inches and the width of the open frame 18 is greater than about 6 inches. Ideally, the length of the open frame 18 is between about 30 inches and about 36 inches and the width of the open frame 18 is about 12 inches.

The net screen 24 is coupled to the end and side portions 19,20,21,22 of the open frame 18 so that the net screen 24 extends across the central opening 23 of the open frame 18. The net screen 24 has a plurality of apertures of a predetermine size such that the net screen 24 blocks passage of items greater than the predetermined size of the apertures from passing through the central opening 23 of the open frame 18. Ideally, the apertures have a diameter or width of about ⅙ inch. The net screen 24 has a central point which is spaced apart from the plane the portions of the open frame 18 lie in when the net screen 24 is extended in a direction away from the common plane. Ideally, the central point of the net screen 24 is spaced apart about 12 inches to define the depth of the pocket formed by the net screen 24 to hold debris collected by the net screen 24.

One of the end portions 19 of the open frame 18 of a first skimming net assembly 17 is pivotally coupled to the distal end 13 of the pole handle 11 at a central point along the length of the end portion of the open frame 18. Preferably, a pivot bracket 25 pivotally couples the one end portion 19 of the open frame 18 to the distal end 13 of the pole handle 11. The pivot bracket 25 has a tightening nut 26 for permitting selective holding of the open frame 18 at a particular angle with respect to the pole frame when the tightening nut 26 is tightened. The other end portion 20 of the open frame 18 of the first skimming net assembly 17 is adapted for detachable attachment to an end portion of an open frame of a second skimming net assembly 27. The side portions of the skimming net assemblies 17,27 are parallel to one another and adjacent side portions are generally collinear.

Preferably, a pair of threaded fasteners 28,29 attach adjacent end portions of the skimming net assemblies 17,27 together.

Figure 5:
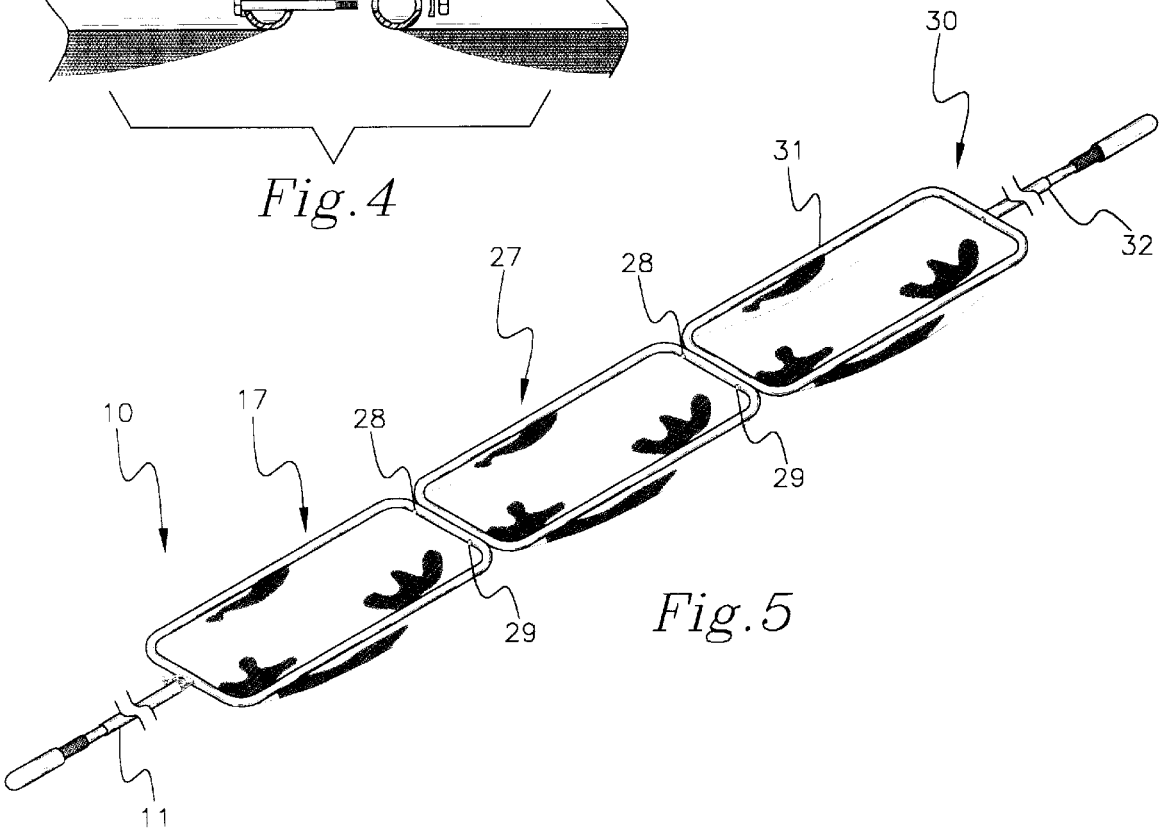
FIG. 5 is a schematic perspective view of a pair of pool skimmers attached together.

As illustrated in FIG. 5, an end portion of the open frame of the skimming net assembly 31 of a second pool skimmer 30 is detachable to another end portion of the second skimming net assembly 27 such that a series of three connected skimming net assemblies is formed having a pole handle 11,32 extending from each end of the series to permit skimming of a larger area of a pool by a pair of users with each user holding on to one of the pair of pole handles 11,32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool skimmer, comprising:

an elongate pole handle having opposite proximal and distal ends;

a plurality of skimming net assemblies, each said skimming net assembly comprising an open frame and a net screen;

said open frame defining a central opening, said open frame being generally rectangular and having a spaced apart pair of elongate end portions, and a spaced apart pair of elongate side portions extending between said end portions of said open frame;

said net screen being coupled to said end and side portions of said open frame, said net screen extending across said central opening of said open frame;

one of said end portions of said open frame of a first skimming net assembly being pivotally coupled to said distal end of said pole handle;

a second skimming net assembly:

another of said end portions of said open frame of said first skimming net assembly being detachably attached to an end portion of an open frame of said second skimming net assembly; and wherein another of said end portions of said open frame of said first skimming net assembly is detachably attached to an end portion of an open frame of said second skimming net assembly, said side portions of said skimming net assemblies being parallel to one another and adjacent side portions of being generally collinear, wherein a pair of threaded fasteners attach adjacent end portions of said skimming net assemblies such that an area of contact between the water and said first and second skimming net assemblies is continuous thereby facilitating passage of water through said net screens of said first and second skimming net assemblies.

2. The pool skimmer of claim 1, said pole handle is telescopically extendable to permit selective lengthening of said pole handle by a user.

3. The pool skimmer of claim 1, wherein said open frame having a length defined between said end portions of said open frame, said open frame having a width defined between said side portions of said open frame, and wherein said length of said open frame is at least twice said width of said open frame.

4. The pool skimmer of claim 3, wherein said length of said open frame is greater than about 24 inches, and wherein said width of said open frame is greater than about 6 inches.

5. The pool skimmer of claim 3, wherein said length of said open frame is between about 30 inches and about 36 inches, wherein said width of said open frame is about 12 inches.

6. The pool skimmer of claim 1, wherein a pair of threaded fasteners attach adjacent end portions of said skimming net assemblies.

7. A pool skimmer, comprising:

an elongate pole handle having opposite proximal and distal ends, and a longitudinal axis extending between said proximal and distal ends of said pole handle;

said pole handle having a generally circular cross section taken generally perpendicular to said longitudinal axis of said pole handle;

said pole handle having a length defined between said proximal and distal ends of said pole handle, wherein said length of said pole handle is greater than about 7 feet;

said pole handle being telescopically extendable to permit selective lengthening of said length of said pole handle by a user, said pole handle having a pair of telescopic portions, wherein said pole handle has a twisting knob at said proximal end of said pole handle, said twisting knob being adapted for releasably holding said telescopic portions of said pole handle in a position to fix said pole handle at a particular length when said twisting knob is tightened;

a pair of skimming net assemblies, each said skimming net assembly comprising an open frame and a net screen;

said open frame being generally rectangular and having a spaced apart pair of elongate end portions, and a spaced apart pair of elongate side portions extending between said end portions of said open frame, said open frame defining a central opening;

said end portions of said open frame being generally parallel to one another, said side portions of said open frame being generally parallel to one another and generally perpendicular to said end portions of said open frame;

said end and side portions of said open frame lying in a generally common plane;

said open frame having a length defined between said end portions of said open frame, said open frame having a width defined between said side portions of said open frame;

wherein said length of said open frame is between about 30 inches and about 36 inches, wherein said width of said open frame is about 12 inches;

said net screen being coupled to said end and side portions of said open frame, said net screen extending across said central opening of said open frame;

said net screen having a plurality of apertures of a predetermine size, said net screen blocking passage of items greater than said predetermined size of said apertures from passing through said central opening of said open frame;

said net screen having a central point, said central point being spaced apart from said plane said portions of said open frame lie in when said net screen is extended in a direction away from said common plane of said portion of said frame, wherein said central point is spaced apart about 12 inches to define said depth of said pocket formed by said net screen to hold debris collected by said net screen;

one of said end portions of said open frame of a first skimming net assembly being pivotally coupled to said distal end of said pole handle at a central point along said length of said end portion of said open frame, wherein a pivot bracket pivotally couples said one end portion of said open frame to said distal end of said pole handle, said pivot bracket having a tightening nut for permitting selective holding of said open frame at a particular angle with respect to the pole frame when said tightening nut is tightened;

a second skimming net assembly; and another of said end portions of said open frame of said first skimming net assembly being detachably attached to an end portion of an open frame of said second skimming net assembly, said side portions of said skimming net assemblies being parallel to one another and adjacent side portions of being generally collinear, wherein a pair of threaded fasteners attach adjacent end portions of said skimming net assemblies such that an area of contact between the water and said first and second skimming net assemblies is continuous thereby facilitating passage of water through said net screens of said first and second skimming net assemblies.

* * * * *